US006662603B2

(12) United States Patent
Morris

(10) Patent No.: US 6,662,603 B2
(45) Date of Patent: Dec. 16, 2003

(54) TUBULAR LATCH

(76) Inventor: Eric D. Morris, 425 Gulph Ridge Dr., King of Prussia, PA (US) 19406

( * ) Notice: Subject to any disclaimer, the term of this patent is extended or adjusted under 35 U.S.C. 154(b) by 0 days.

(21) Appl. No.: 10/252,265

(22) Filed: Sep. 23, 2002

(65) Prior Publication Data

US 2003/0061848 A1 Apr. 3, 2003

Related U.S. Application Data

(63) Continuation-in-part of application No. 10/219,140, filed on Aug. 15, 2002.

(60) Provisional application No. 60/325,698, filed on Sep. 28, 2001.

(51) Int. Cl.[7] ..... E05B 59/00; E05B 63/06; E05C 1/12

(52) U.S. Cl. ..... 70/107; 292/DIG. 61; 292/169.19; 292/169; 70/451; 70/461

(58) Field of Search ..... 70/107, 109, 110, 70/111, 141, 451, 461; 292/1.5, 337, DIG. 60, DIG. 61, 165, 169, 169.19

(56) References Cited

U.S. PATENT DOCUMENTS

| | | | | | |
|---|---|---|---|---|---|
| 3,208,785 | A | * | 9/1965 | James | 292/337 |
| 3,405,960 | A | * | 10/1968 | Wargo | 292/145 |
| 3,492,038 | A | * | 1/1970 | Schlage et al. | 292/78 |
| 3,860,276 | A | * | 1/1975 | Lambrecht | 292/169 |
| 3,950,974 | A | | 4/1976 | Alexander | |
| 4,118,056 | A | | 10/1978 | Alexander | |
| 4,481,796 | A | | 11/1984 | Hamme | |
| 4,496,178 | A | * | 1/1985 | Best et al. | 292/1.5 |
| 4,572,556 | A | | 2/1986 | Foshee | |
| 4,656,849 | A | * | 4/1987 | Rotondi et al. | 70/134 |
| 4,695,082 | A | | 9/1987 | Marks | |
| 4,767,140 | A | * | 8/1988 | Lin | 292/337 |
| 4,852,918 | A | * | 8/1989 | Allen | 292/169 |
| 4,957,315 | A | * | 9/1990 | Lin | 292/337 |
| 5,020,836 | A | | 6/1991 | Su | |
| 5,246,258 | A | * | 9/1993 | Kerschenbaum et al. | 292/144 |
| 5,678,870 | A | | 10/1997 | Pelletier | |
| 5,690,372 | A | * | 11/1997 | Jans | 292/169 |
| 5,927,770 | A | * | 7/1999 | Huang | 292/169.14 |
| 5,979,948 | A | * | 11/1999 | Aramburu | 292/1.5 |
| 6,250,119 | B1 | | 6/2001 | Flon | |
| 6,282,929 | B1 | | 9/2001 | Eller et al. | |

FOREIGN PATENT DOCUMENTS

GB 2053338 A * 2/1981

OTHER PUBLICATIONS

Eric D. Morris, "Statement of Eric D. Morris", Oct. 15, 2002, in U.S. Ser. No. 10/219,140 (parent to the present CIP application).

* cited by examiner

*Primary Examiner*—Anthony Knight
*Assistant Examiner*—Michael J. Kyle
(74) *Attorney, Agent, or Firm*—Caesar, Rivise, Bernstein, Cohen & Pokotilow, Ltd.

(57) ABSTRACT

A tubular latch is provided which includes a case, a bolt, a hub rotatably mounted within the latch case to receive a door handle shaft, a cam integral to an outer surface of the hub and having a driving surface wherein rotational movement of the hub causes the driving surface to rotate with the hub, and a slider member movable, by the cam, from a first axial position in the latch case wherein the slider member is in an extended position to a second axial position wherein the slider member is in a retracted position. The latch further includes a latch spring adjuster plate moveable axially within the latch case that is adjustable and securable to a desired axial position within the latch case, and a slider member spring for biasing the slider member away from the latch spring adjuster plate.

9 Claims, 3 Drawing Sheets

FIG.1
PRIOR ART
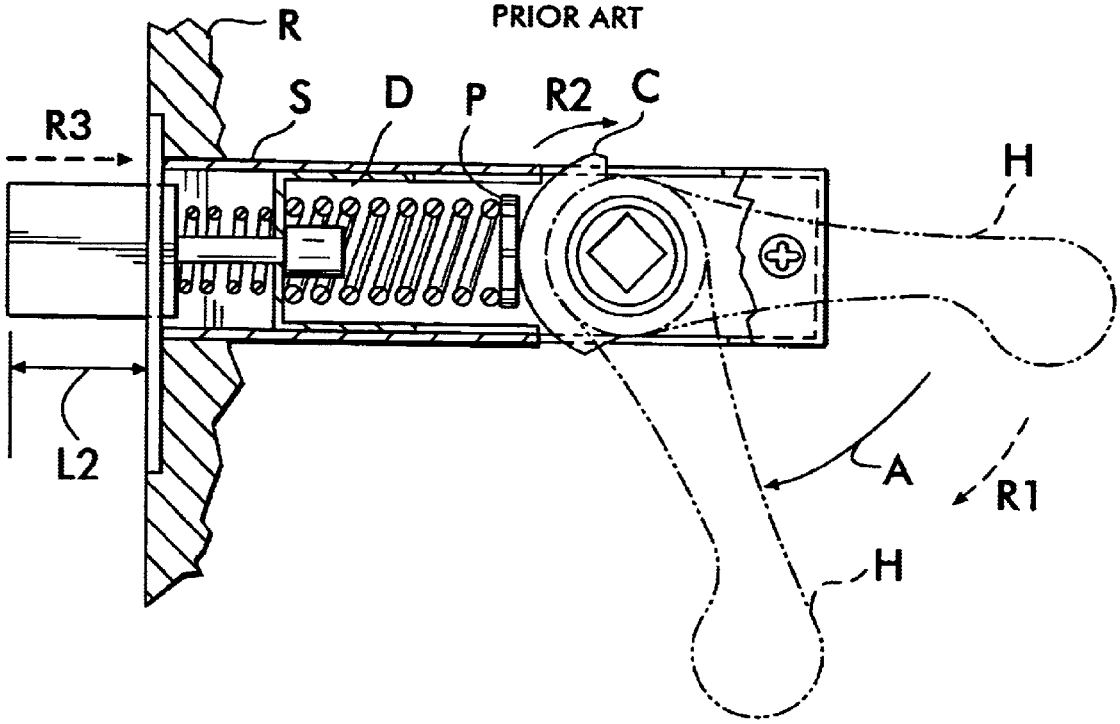
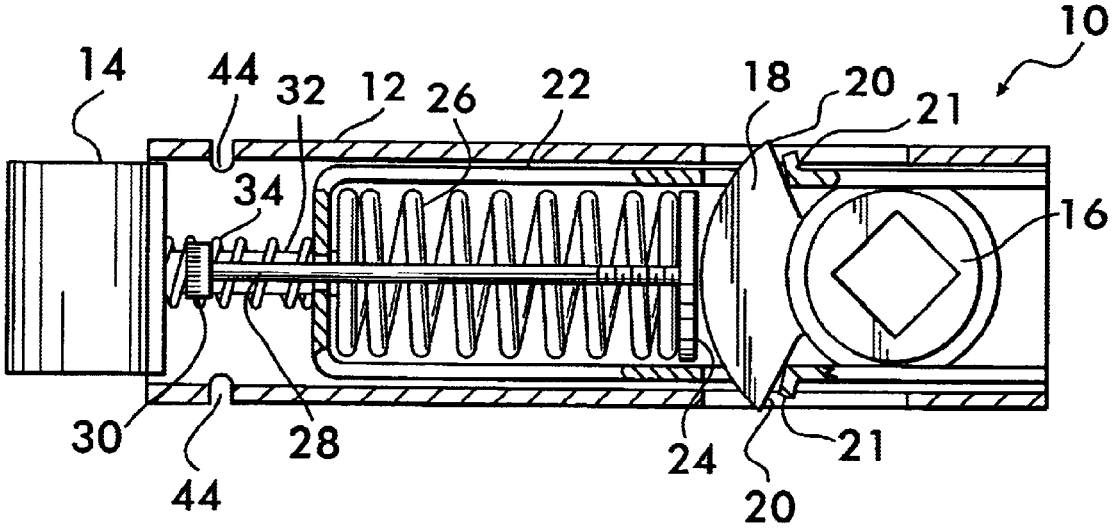
FIG.2

FIG.3
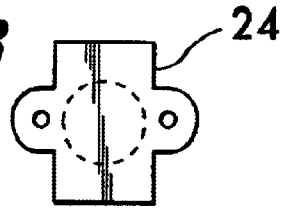
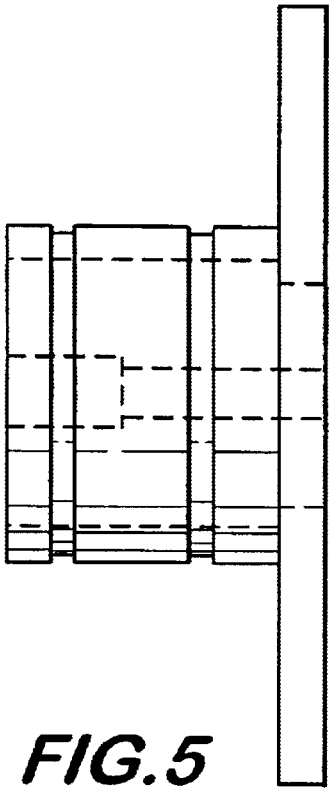
FIG.5
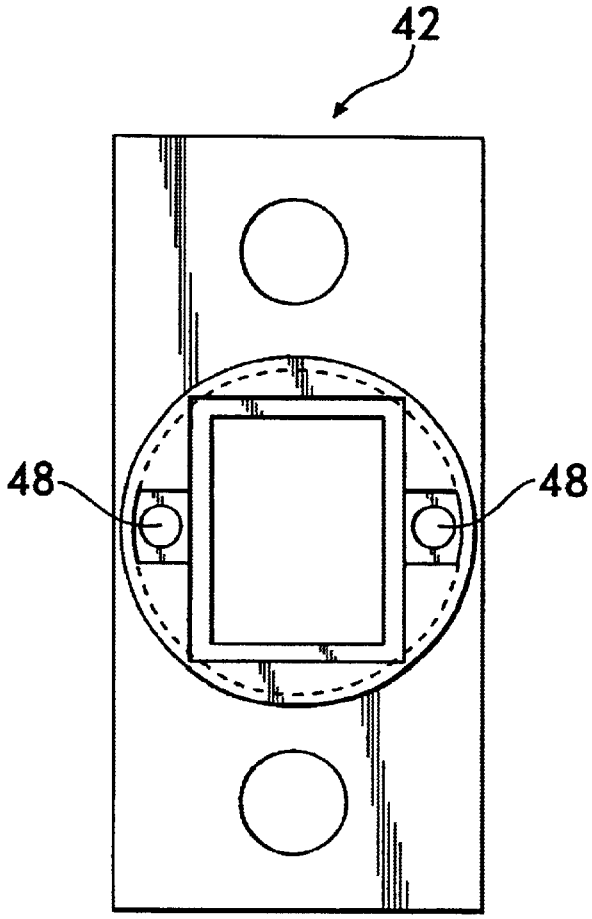
FIG.4

FIG. 6
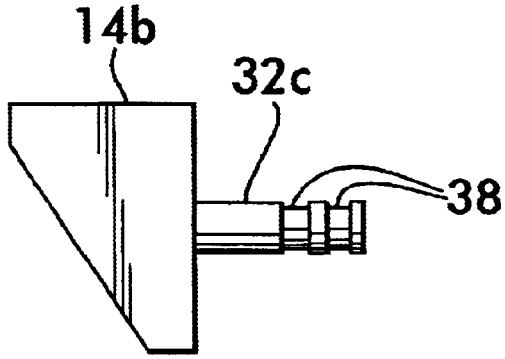
FIG. 7
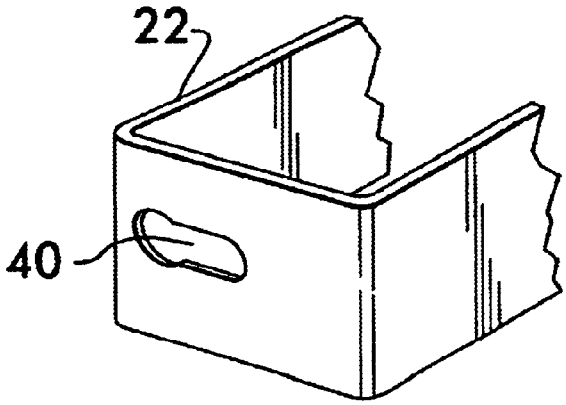
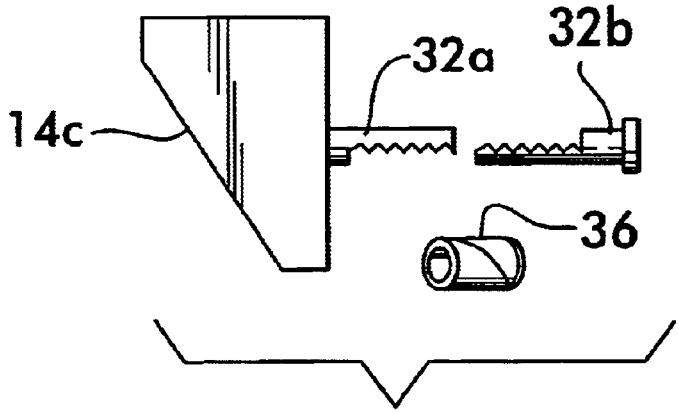
FIG. 8

TUBULAR LATCH

CROSS REFERENCE TO RELATED APPLICATION

This application claims the benefit of U.S. Provisional Application Serial No. 60/325,698, entitled Mortise Lock, filed on Sep. 28, 2001 and is a Continuation-In-Part application of U.S. application Ser. No. 10/219,140 filed Aug. 15, 2002, entitled Mortise Latch.

BACKGROUND OF THE INVENTION

Tubular latches are the most common latching devices used for residential and commercial doors today. They are available in two "backsets," 2¾ inches and 2⅜ inches. Backset is the distance from the face of the latch to the center of the latch hub/spindle. Tube latches also typically have two spring strengths, one spring strength for levers and one spring strength for knobs. The lever latch has a relatively strong spring for several reasons. First, the spring is strong to support the weight of the levers which are cantilevered from the center of the latch hub. Second, the spring is strong to resist the added torque created by the lever. The knob latch has a relatively weaker spring since the weight of its knobs is evenly distributed around the latch hub. Additionally, the knob is smaller and therefore a user applies less torque to the latch hub when rotating the knob.

Tubular latches also come in an assortment of variations. Typically, manufacturers use one of two finishes for the latch bolt, satin brass and satin nickel. A tubular latch may also be available in either a "passage" type or a "privacy" type. A passage latch is used on doors where no privacy is required such as closets, pantries, laundry rooms, and the like. A privacy latch is used where privacy is required, such as bathrooms, bedrooms, and the like. The privacy feature is integral to the latch body. A pushbutton operates perpendicular to the face of the door to engage the privacy feature and prevent the latch from allowing the door to open. Pushing the pushbutton towards the latch activates the privacy feature and rotating the knob or lever about the latch hub cancels the privacy feature and allows the latch to be unlatched.

Tube latches are required to fit a specific door preparation. The maximum diameter of the latch body is typically one inch. The face plate is typically one inch by two inches. The backset is either 2⅜ inches or 2¾ inches. Privacy latches are typically used on doors predrilled with a 2⅛ inch hole through the door faces.

In the past, lock dealers were required to inventory specific latches for each combination of backset, spring strength, finish, and privacy or passage type. This resulted in the dealer having to inventory numerous individual latches. The present invention allows one latch to be used for knob strength, lever strength, and backset (2⅜ inch or 2¾ inch). A privacy adapter may be added for the privacy feature. Therefore, a dealer will only have to inventory one latch for each finish, e.g., a satin brass latch and a satin nickel latch, and one privacy adaptor.

A conventional tubular latch as shown in FIG. 1 includes a latch L resiliently held in a housing S fixed in a tubular hole formed in a door R and operatively retracted for opening the door by biasing a door handle H (direction R1) whereby a cam C as rotated (in direction R2) by the handle H will pull a driving plate D secured with the latch L to retract the latch L in rearward direction R3 for opening the door.

For biasing the handle H for opening the door, a rotating angle A (such as 70 degrees) provides a stroke L2 for retracting the latch L in direction R3 for opening the door. This is equal to an arc length of the rotated cam C of the handle H and the retraction of the latch L is directly actuated by rotating the cam C and handle H.

U.S. Pat. No. 5,020,836 discloses a tubular latch that includes a biasing lever pivotally mounted on the housing of the latch. Here, the novel feature of this invention is the addition of a biasing lever and related structure which allows for a smaller degree of handle rotation to fully open the latch bolt. This patent is fully incorporated by reference.

BRIEF SUMMARY OF THE INVENTION

A tubular latch is provided which includes a latch case, a latch bolt, a hub having a cam, a slider member, a latch spring adjuster plate, and a slider member spring. The latch bolt is axially movable within the latch case from an extended position to a retracted position. The hub is rotatably mounted within the latch case and receives a door handle shaft. The hub is rotatable from a first position wherein the latch bolt is in the extended position to a second position wherein the latch bolt is in the retracted position. The cam is integral to an outer surface of the hub and has one or two driving surfaces. Rotational movement of the hub causes the driving surface to rotate with the hub. The slider member is movable from a first axial position in the latch case wherein the slider member is in an extended position to a second axial position in the latch case wherein the slider member is in a retracted position. The slider member is moveable by rotational movement of the hub causing the driving surface of the cam to drive the slider member from the extended position to the retracted position. The latch spring adjuster plate is moveable axially within the latch case and is adjustable and securable to a desired axial position within the latch case. Finally, a slider member spring is included for biasing the slider member away from the latch spring adjuster plate, whereby changing of the desired axial position of the latch spring adjuster plate changes an initial compression amount of the slider member spring.

One or more adjuster plate screws may be used for securing the latch spring adjuster plate to the desired position within the case. The adjuster plate screws may includes a screw head accessible from the outside of the casing. The screw head is preferably adjacent to the latch bolt. A latch bolt shaft connected between the latch bolt and the slider member may be included that is adjustable in length. Here, the latch bolt shaft may include a front latch bolt portion and a rear slider member portion where the front latch bolt portion and the rear slider member portion are adapted to be secured to one another by a spring clip. Finally, the latch bolt shaft may be a one-piece integral unit where the shaft has a plurality of grooves. One of the grooves may be for being received in a slider member keyhole slot to allow for effective adjustability of length of the latch bolt.

BRIEF DESCRIPTION OF SEVERAL VIEWS OF THE DRAWINGS

The invention will be described in conjunction with the following drawings in which like reference numerals designate like elements and wherein:

FIG. 1 cutaway, front elevational view of a prior art tubular latch.

FIG. 2 is a cutaway, front elevational view of a tubular latch (excluding a latch carrier) in accordance with one preferred embodiment of the present invention.

FIG. 3 is a front view of a latch spring adjuster plate for use with the tubular latch of FIG. 2.

FIG. 4 is a front elevation view of latch carrier for securing the tubular latch of FIG. 2 in a door.

FIG. 5 is a side elevation view of the latch carrier of FIG. 4.

FIG. 6 is a side elevation view of an adjustable latch bolt and shaft for use with the tubular latch of FIG. 2.

FIG. 7 is a partial isometric view of a slider member for use with the adjustable latch bolt and shaft of FIG. 6.

FIG. 8 is a side elevation view of an alternate embodiment of a latch bolt and shaft (with spring clip) for use with the tubular latch of FIG. 2.

DETAILED DESCRIPTION OF THE INVENTION

Referring now to the drawings, wherein like part numbers refer to like elements throughout the several views, there is shown in FIG. 2 a tubular latch 10 in accordance with one preferred embodiment of the present invention. The tubular latch 10 includes a latch case 12, a latch bolt 14, a hub 16, a slider member 22, and a slider member spring 26. As described above with respect to a prior art tubular latch, rotation of the hub 16 (by a handle or knob) causes a cam 18 to rotate. The cam 18 has a pair of driving surfaces 20, one of which bears against one of surfaces 21 on the slider member 22 which causes the slider member 22 to move axially (to the right in the drawing) against the slider member spring 26. When the slider member 22 moves axially to the right, it draws the latch bolt 24 to its retracted position. When the hub 16 is freed to rotate back to its home position (i.e., the handle is let go), the spring 26 causes the latch bolt to extend back out to its fully extended position. The latch bolt 14 may extend and retract independently of the rest of the tubular latch mechanism via spring 34. Other elements of a tubular latch not described here are well known elements in the prior art, for example, as shown in FIG. 1.

The tubular latch 10 is secured in the latch carrier 42 as shown in FIGS. 4 and 5. Latch notches 44 are aligned with latch carrier notches 46 and are secured with a spring clip (not shown) thereby securely mating the tubular latch 10 with its latch carrier in a door (see FIG. 1 for an example of door installation).

Two novel features of a preferred embodiment of the tubular latch 10 will now be described in detail. The first is an adjustable spring tension feature to allow for use of either a knob or a lever, and the second is an adjustable latch bolt shaft length to allow the tubular latch 10 to be installed in doors requiring a backset of, for example, either 2¾ inches or 2⅜ inches.

The adjustable spring tension feature is as follows. In prior art tubular latch designs, a latch spring plate P bears directly on the cam C of the latch. See FIG. 1. As can be seen in FIGS. 2 and 4, the preferred design of the present invention uses three elements: a latch spring adjuster plate 24, a pair of adjuster plate screws 28 and a pair of counterbored through holes 48. The latch spring adjuster plate 24 has a pair of threaded holes for accepting the threaded adjuster plate screws 28. The latch spring adjuster plate 24 travels axially within the slider member 22 (and latch case 12) and may be continuously adjusted by turning the adjuster plate screws 28 (via screw heads 30 that are accessible on the latch carrier 42) thereby shortening or lengthening the distance between the latch bolt 14 and the latch spring adjuster plate 24. The spring 26 remains captured between the latch spring adjuster plate 24 and an end of the slider member 22. By shortening or lengthening this distance, the static length of the spring 26 is increased or decreased thereby increasing or decreasing the amount of force required at the hub 16 to move the latch bolt 14 to its retracted position. Either knobs or levers can thereby be accommodated.

The second novel feature is an adjustable latch bolt shaft length to allow the tubular latch 10 to be installed in doors requiring a backset of, for example, either 2¾ inches or 2⅜ inches. This can be accomplished in several ways, for example, as shown in FIGS. 6–8. As can be seen in FIGS. 6 and 7, the length of the latch bolt shaft 32C can be adjusted by including grooves 38 that are adapted to fit into keyhole slot 40 of the slider member. As shown here, there are two grooves 38. One of these grooves 38 may be set to properly size the latch bolt for a 2¾ inch backset while the second of these grooves may be set to properly size the latch bolt for a 2⅜ inch backset. It is understood that many other similar means may be used, for example, using C-clips in a round through hole that fit into the grooves 38 rather than the using the keyhole slot 40 as shown here. As can be seen in FIG. 8, another device for adjusting the length of the latch bolt shaft is shown. Here, the latch bolt shaft has two portions 32*a* and 32*b* these fit together by mating knurling and then are rigidly secured to one another by a spring clip 36.

While the invention has been described in detail and with reference to specific examples thereof, it will be apparent to one skilled in the art that various changes and modifications can be made therein without departing from the spirit and scope thereof.

I claim:

1. A tubular latch, comprising:

a) a latch case;

b) a latch bolt, said latch bolt axially movable within said latch case from an extended position to a retracted position;

c) a hub rotatably mounted within the latch case and adapted to receive a door handle shaft, said hub rotatable from a first position wherein said latch bolt is in said extended position to a second position wherein said latch bolt is in said retracted position;

d) a cam, integral to an outer surface of said hub, said cam having at least one driving surface wherein rotational movement of said hub causes said driving surface to rotate with said hub;

e) a slider member, said slider member movable from a first axial position in said latch case wherein said slider member is in an extended position to a second axial position in said latch case wherein said slider member is in a retracted position, said slider member moveable by rotational movement of said hub causing said driving surface of said cam to drive said slider member from the extended position to the retracted position;

f) a latch spring adjuster plate moveable axially within said latch case, said latch spring adjuster plate adjustable and securable to a desired axial position within said latch case; and g) a slider member spring for biasing said slider member away from the latch spring adjuster plate, whereby changing of the desired axial position of the latch spring adjuster plate changes an initial compression amount of the slider member spring; and h) a latch bolt shaft connected between said latch bolt and said slider member, said latch bolt shaft being adjustable in length.

2. A tubular latch in accordance with claim 1 including at least one adjuster plate screw for securing the latch spring adjuster plate to the desired position within said case.

3. A tubular latch in accordance with claim 2, wherein said at least one adjuster plate screw includes a screw head accessible from an outer surface of said casing.

4. A tubular latch in accordance with claim 3, wherein said screw head is adjacent the latch bolt.

5. A tubular latch in accordance with claim 1, wherein said latch bolt shaft includes a front latch bolt portion and a rear slider member portion, said front latch bolt portion and said rear slider member portion adapted to be secured to one another by a spring clip.

6. A tubular latch in accordance with claim 1, wherein said latch bolt shaft is a one-piece integral unit, said shaft having a plurality of grooves, one of said grooves adapted for being received in a slider member keyhole slot to allow for effective adjustability of length of the latch bolt.

7. A tubular latch, comprising:

a) latch case;

b) a latch bolt, said latch bolt axially movable within said latch case from an extended position to a retracted position;

c) a hub rotatably mounted within the latch case and adapted to receive a door handle shaft, said hub rotatable from a first position wherein said latch bolt is in said extended position to a second position wherein said latch bolt is in said retracted position;

d) a cam, integral to an outer surface of said hub, said cam having at least one driving surface wherein rotational movement of said hub causes said driving surface to rotate with said hub;

e) a slider member, said slider member movable from a first axial position in said latch case wherein said slider member is in an extended position to a second axial position in said latch case wherein said slider member is in a retracted position, said slider member moveable by rotational movement of said hub causing said driving surface of said cam to drive said slider member from the extended position to the retracted position;

f) a latch spring adjuster plate moveable axially within said latch case, said latch spring adjuster plate adjustable and securable to a desired axial position within said latch case;

g) a slider member spring for biasing said slider member away from the latch spring adjuster plate, whereby changing of the desired axial position of the latch spring adjuster plate changes an initial compression amount of the slider member spring;

h) at least one adjuster plate screw for securing the latch spring adjuster plate to the desired position within said case, said at least one adjuster plate screw includes a screw head adjacent to the latch bolt that is accessible from an outer surface of said casing; and i) a latch bolt shaft connected between said latch bolt and said slider member, said latch bolt shaft being adjustable in length.

8. A tubular latch in accordance with claim 7, wherein said latch bolt shaft includes a front latch bolt portion and a rear slider member portion, said front latch bolt portion and said rear slider member portion adapted to be secured to one another by a spring clip.

9. A tubular latch in accordance with claim 7, wherein said latch bolt shaft is a one-piece integral unit, said shaft having a plurality of grooves, one of said grooves adapted for being received in a slider member keyhole slot to allow for effective adjustability of length of the latch bolt.

* * * * *